US008952622B2

(12) United States Patent
Lee et al.

(10) Patent No.: US 8,952,622 B2
(45) Date of Patent: Feb. 10, 2015

(54) LIGHT EMITTING DIODE DRIVING APPARATUS, DRIVING METHOD OF LIGHT EMITTING DIODE, AND COMPUTER-READABLE RECORDING MEDIUM

(71) Applicant: Samsung Electronics Co., Ltd., Suwon-si (KR)

(72) Inventors: Sang-hoon Lee, Suwon-si (KR); Myoung-jun Lee, Bucheon-si (KR); Byeong-cheol Hyeon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 52 days.

(21) Appl. No.: 13/779,929

(22) Filed: Feb. 28, 2013

(65) Prior Publication Data

US 2014/0001975 A1 Jan. 2, 2014

(30) Foreign Application Priority Data

Jun. 27, 2012 (KR) ..... 10-2012-0069163

(51) Int. Cl.
*H05B 37/02* (2006.01)
*H05B 33/08* (2006.01)

(52) U.S. Cl.
CPC ..... *H05B 33/0815* (2013.01); *H05B 33/0851* (2013.01); *H05B 33/0827* (2013.01)
USPC ..... 315/244

(58) Field of Classification Search
CPC ..... H05B 37/02; H05B 33/00
USPC ..... 315/291, 307, 312, 185 R, 224, 247, 246
See application file for complete search history.

(56) References Cited

U.S. PATENT DOCUMENTS

| | | | | |
|---|---|---|---|---|
| 7,923,943 | B2 * | 4/2011 | Peker et al. | 315/312 |
| 7,948,455 | B2 * | 5/2011 | Han et al. | 345/82 |
| 8,125,161 | B2 | 2/2012 | Kim et al. | |
| 2009/0230874 | A1 | 9/2009 | Zhao et al. | |
| 2010/0013395 | A1 | 1/2010 | Archibald et al. | |
| 2010/0141162 | A1 * | 6/2010 | Matsumoto et al. | 315/186 |
| 2010/0320921 | A1 | 12/2010 | Kim et al. | |
| 2011/0062872 | A1 | 3/2011 | Jin et al. | |

FOREIGN PATENT DOCUMENTS

| | | | |
|---|---|---|---|
| JP | 2007-134430 | A | 5/2007 |
| KR | 10-0969876 | B1 | 7/2010 |
| KR | 10-1021247 | B1 | 3/2011 |
| KR | 10-1118831 | B1 | 3/2012 |

OTHER PUBLICATIONS

Communication dated Sep. 26, 2013 issued by the European Patent Office in counterpart European Patent Application No. 13158211.6.

* cited by examiner

*Primary Examiner* — Minh D A
(74) *Attorney, Agent, or Firm* — Sughrue Mion, PLLC

(57) ABSTRACT

A light emitting diode (LED) driving apparatus includes a DC-DC converter which provides a driving voltage to a plurality of LED arrays; a plurality of switching units, each of the switching units being connected in series to a corresponding LED array of the plurality of LED arrays and varying a size of a driving current to flow in the corresponding LED array of the plurality of LED arrays; and a control unit which, in order for each of the switching units to operate within a predetermined headroom voltage range, calculates a driving current of each of the plurality of LED arrays and a duty cycle of the switching units corresponding to each of the plurality of LED arrays, and controls the plurality of switching units based on the calculated driving current and the calculated duty cycle.

19 Claims, 6 Drawing Sheets

DACB=D*iled_ini / (iled-iACB)

[iref=100mV, D=0.5 condition]
1. When iACB2=0mV ? 50mV
2. Vgs2= 4V → 4.2V
3. iled2=100mA → 150mA
4. Vf2=97V → 98.5V
5. Vh2=3V → 1.5V
6. DACB2=0.5 → 0.33

LIGHT EMITTING DIODE DRIVING APPARATUS, DRIVING METHOD OF LIGHT EMITTING DIODE, AND COMPUTER-READABLE RECORDING MEDIUM

CROSS-REFERENCE TO RELATED APPLICATION

This application claims the benefit under 35 U.S.C. §119 (a) from Korean Patent Application No. 10-2012-0069163 filed Jun. 27, 2012 in the Korean Intellectual Property Office, the disclosure of which is incorporated herein by reference in its entirety.

BACKGROUND

1. Field

Exemplary embodiments disclosed herein relate to a light emitting diode (LED) driving apparatus, a LED driving method, and a computer-readable recording medium. More particularly, exemplary embodiments disclosed herein relate to a light emitting diode driving apparatus, a LED driving method, and a computer-readable recording medium which can reduce heat of a switching component and control independently each of a plurality of LED arrays.

2. Description of the Related Art

Since a liquid crystal display (LCD) is thin and light, and has a driving voltage and power consumption which is lower than other display apparatuses, liquid crystal displays are widely used. However, since the liquid crystal display cannot emit light by itself and is a non-light emitting component, the liquid crystal display needs a separate backlight unit to supply light.

Cold cathode fluorescent lamps (CCFLs), light emitting diodes (LEDS), etc. are often used as a backlight light source of the liquid crystal display. The cold cathode fluorescent lamps may cause environmental pollution because of mercury. Further, cold cathode fluorescent lamps have a slow speed of response and lower color reproducibility, and are not suitable to make lighter, slimmer and smaller LCD panels.

In contrast, the LED does not use environmentally harmful substances and is therefore environmentally friendly, and has the advantage of being impulse-driven. Further, since LED technology has excellent color reproducibility, can randomly change luminance, color temperature, etc. by adjusting the amount of light of red, green and blue LEDs, and is suitable for manufacturing lighter, slimmer and smaller LCD panels, the LED is often used as a backlight light source of LCD panels. In an LCD backlight employing LEDs, in order to improve the image quality and to reduce power consumption, current being supplied to the LEDs is varied corresponding to brightness information of images.

Recently, display apparatuses with high definition and built-in 3D functions use an LED backlight unit configured of a plurality of channels (or a plurality of LED arrays). A current source apparatus which can independently control current of each of the channels is required to drive the LED backlight unit configured with the plurality of channels. For current control, a conventional LED backlight unit uses a switch mode type circuit or a linear mode type circuit.

The conventional switch mode type circuit is provided with a complete power conversion circuit for each LED array, and can perform current control regardless of variation of the forward voltage Vf of each LED array. However, since power components having the same function are used redundantly, there is a drawback that the size and price of the circuit are increased.

The conventional linear mode type circuit is provided with a variable voltage source apparatus to control total voltage thereof and linear switches to separately control current of each channel. Therefore, the size of the conventional linear mode type circuit is relatively small and the price of the entire circuit is reduced, as compared to the conventional switch mode type circuit. However, since an increase in a variation of the forward voltage Vf of each LED array causes a corresponding increase in heat of the linear switch, efficiency may be reduced and a reliability problem may occur.

SUMMARY

The exemplary embodiments disclosed herein have been developed in order to overcome the above drawbacks and other problems associated with the conventional arrangement. An aspect of the exemplary embodiments is to provide an LED driving apparatus, an LED driving method, and a computer-readable recording medium which can reduce heat of switch components and control independently each of a plurality of LED arrays.

According to an exemplary embodiment, the above aspect and/or other features can substantially be achieved by providing a light emitting diode (LED) driving apparatus, which includes a DC-DC converter which provides a driving voltage to a plurality of LED arrays; a plurality of switching units, each of the switching units being connected in series to a corresponding LED array of the plurality of LED arrays and varying a size of a driving current to flow in the corresponding LED array of the plurality of LED arrays; and a control unit which, in order for each of the switching units to operate within a predetermined headroom voltage range, calculates a driving current of each of the plurality of LED arrays and a duty cycle of the switching units corresponding to each of the plurality of LED arrays, and controls the plurality of switching units based on the calculated driving current and the calculated duty cycle.

The control unit may receive brightness information with respect to each of the plurality of LED arrays, calculate an average driving current of each of the plurality of LED arrays based on the received brightness information, calculate a driving current to be supplied to each of the plurality of LED arrays so that each of the corresponding plurality of switching units operate within the predetermined headroom voltage range, calculate a duty cycle of each of the plurality of switching units based on the calculated average driving current and the calculated driving current, and control the plurality of switching units based on the calculated driving current and the calculated duty cycle.

The control unit may control the DC-DC converter to provide the plurality of LED arrays with a sum of a forward voltage of an LED array having a largest forward voltage among the plurality of LED arrays and a lower voltage of the predetermined headroom voltage range as the driving voltage.

The control unit may include a reference controller which calculates an average driving current of each of the plurality of LED arrays and generates an upper voltage value and a lower voltage value of the predetermined headroom voltage range; an average current controller which calculates a driving current of each of the plurality of LED arrays by using the calculated average driving current, and further calculates a duty cycle of the switching units corresponding to each of the plurality of LED arrays by using the calculated average driving current, the driving current and the duty cycle being calculated in order for each of the plurality of switching units to operate between the upper voltage value and the lower voltage value; and a plurality of current controllers, each of the current controllers controlling a corresponding switching unit of the plurality of switching units based on the calculated driving current and the calculated duty cycle.

The reference controller may receive brightness information with respect to each of the plurality of LED arrays, and calculate the average driving current of each of the plurality of LED arrays based on the received brightness information.

The average current controller may control the DC-DC converter to supply the calculated driving voltage to the plurality of LED arrays.

The average current controller may control the DC-DC converter to supply a sum of a forward voltage of the LED array having a largest forward voltage among the plurality of LED arrays and a lower voltage of the predetermined headroom voltage range as the driving voltage with respect to the plurality of LED arrays.

The average current controller may calculate the driving current of each of the plurality of LED arrays by using the calculated average driving current in order for each of the plurality of switching units to operate between the upper voltage value and the lower voltage value, and calculate the duty cycle of each of the plurality of switching units based on the average driving current calculated by the reference controller and the calculated driving current.

In order for each of the plurality of switching units to operate between the upper voltage value and the lower voltage value, the average current controller may calculate a driving current having a value which is increased compared to the average driving current calculated with respect to the other LED arrays except for the LED array having a largest forward voltage among the plurality of LED arrays.

The average current controller may calculate a duty cycle which is lower than a duty cycle of the LED array having the largest forward voltage with respect to the other LED arrays except for the LED array having the largest forward voltage among the plurality of LED arrays.

Each of the plurality of switching units may include a resistor including one end which is grounded; and a switching component connected in series between the corresponding LED array and the resistor.

The switching component may include a bipolar junction transistor (BJT) including a collector which is connected to one end of the corresponding LED array, a base connected to the corresponding current controller, and an emitter grounded through the resistor; and each of the plurality of current controllers may provide the base of the corresponding BJT with a value of voltage corresponding to the calculated driving current.

The switching component may include a field effect transistor (FET) including a drain connected to one end of the corresponding LED array, a gate connected to the corresponding current controller, and a source grounded through the resistor, and each of the plurality of current controllers may provide the gate of the corresponding FET with a value of voltage corresponding to the calculated driving current.

Each of the current controllers may perform feedback control of driving current to flow in the corresponding LED array by using a voltage value of the resistor.

The control unit may include a plurality of comparators corresponding to the plurality of switching units, each of the comparators outputting a difference between the value of voltage corresponding to the driving current calculated in the average current controller and the voltage value of the resistor in the corresponding switching unit.

Each of the plurality of current controllers may perform feedback control of driving current to flow in the corresponding LED array based on an output of the corresponding comparator.

According to another aspect of the present disclosure, a light emitting diode (LED) driving method of an LED driving apparatus which includes a plurality of LED arrays and a plurality of switching units configured to vary a size of a driving current to flow in each of the plurality of LED arrays may include receiving brightness information with respect to each of the plurality of LED arrays; calculating an average driving current of each of the plurality of LED arrays based on the received brightness information; calculating a driving current of each of the plurality of LED arrays in order for each of the plurality of switching units to operate within a predetermined headroom voltage range; calculating a duty cycle of each of the plurality of switching units based on the calculated average driving current and the calculated driving current; and controlling the plurality of switching units based on the calculated driving current and the calculated duty cycle.

The calculating of the driving current may include calculating the driving current to have a value which is increased compared to the average driving current calculated with respect to the other LED arrays except for an LED array having a largest forward voltage among the plurality of LED arrays in order for each of the plurality of switching units to operate within the predetermined headroom voltage range.

The calculating of the duty cycle may include calculating the duty cycle to be lower than a duty cycle of the LED array having the largest forward voltage with respect to the other LED arrays except for the LED array having the largest forward voltage among the plurality of LED arrays.

According to another exemplary embodiment, a non-transitory computer-readable recording medium may include a program for executing a light emitting diode (LED) driving method in an LED driving apparatus which comprises a plurality of LED arrays and a plurality of switching units configured to vary a size of a driving current to flow in each of the plurality of LED arrays, the non-transitory computer-readable recording medium causing a computer to execute the LED driving method including receiving brightness information with respect to each of the plurality of LED arrays; calculating an average driving current of each of the plurality of LED arrays based on the received brightness information; calculating a driving current of each of the plurality of LED arrays in order for each of the plurality of switching units to operate within a predetermined headroom voltage range; calculating a duty cycle of each of the plurality of switching units based on the calculated average driving current and the calculated driving current; and controlling the plurality of switching units based on the calculated driving current and the calculated duty cycle.

According to another exemplary embodiment, a light emitting diode (LED) driving apparatus includes an LED array which emits light; a switching unit which is connected to the LED array and which supplies current to the LED array; and a control unit which varies a duty cycle to thereby vary the current supplied to the LED array and to maintain a desired brightness level of the LED array.

Other objects, advantages and salient features of the present disclosure will become apparent from the following detailed description, which, taken in conjunction with the annexed drawings, discloses preferred embodiments.

BRIEF DESCRIPTION OF THE DRAWINGS

These and/or other aspects and advantages of the exemplary embodiments will become apparent and more readily appreciated from the following description of the exemplary embodiments, taken in conjunction with the accompanying drawings of which.

Throughout the drawings, like reference numerals will be understood to refer to like parts, components and structures.

DETAILED DESCRIPTION OF THE EXEMPLARY EMBODIMENTS

Hereinafter, certain exemplary embodiments will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

Figure 1:
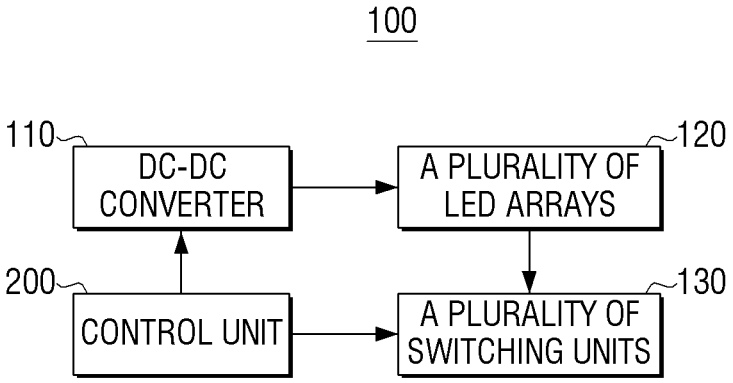
FIG. 1 is a block diagram illustrating an LED driving apparatus according to an exemplary embodiment.

FIG. 1 is a block diagram illustrating an LED driving apparatus according to an exemplary embodiment.

Referring to FIG. 1, the LED driving apparatus 100 according to an exemplary embodiment includes a DC-DC converter 110, a plurality of LED arrays 120, a plurality of switching units 130 and a control unit 200.

The DC-DC converter 110 provides a driving voltage to the plurality of LED arrays 120. Specifically, the DC-DC converter 110 includes a power transistor to perform a switching operation and provides the driving voltage to the plurality of LED arrays 120 by the switching operation of the power transistor. More specifically, the DC-DC converter 110 may convert DC voltage based on a control signal (for example, a pulse width modulation (PWM) signal) provided from the control unit 200, and may provide the converted DC voltage to the plurality of LED arrays 120.

Figure 5:
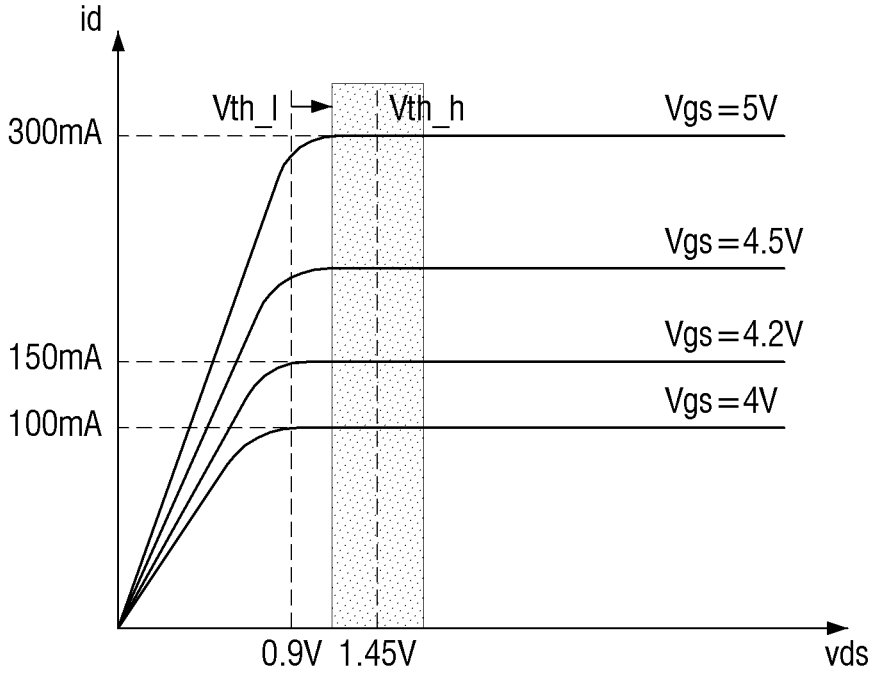
FIG. 5 is a view illustrating operation characteristics of a switching unit of FIG. 1.

In order for the plurality of LED arrays 120 to operate in a saturation zone, the DC-DC converter 110 may provide the plurality of LED arrays 120 with a sum of a forward voltage of an LED array 120 having the largest forward voltage Vf (or the largest forward bias voltage) among the plurality of LED arrays 120 and a lower voltage of a predetermined headroom voltage range as the driving voltage. According to an exemplary embodiment, the predetermined headroom voltage range, as illustrated in FIG. 5, is a voltage range of the saturation zone to allow the switching component to operate in a linear area.

Since voltage of a saturation zone over a saturation point is used in the present exemplary embodiment, even when the driving voltage provided to the LED array 120 or the forward voltage Vf of the LED array 120 is changed, variation of the driving current to flow in the LED array 120 is insubstantial. The headroom voltage range may be changed to correspond to a change of an operation mode of a display apparatus to which the LED driving apparatus 100 is mounted.

The plurality of LED arrays 120 is formed such that LED arrays 120 to perform a light-emitting operation are connected in parallel. According to exemplary embodiments, one LED array 120 may be configured of one LED light emitting element or multiple LED light emitting elements connected in series.

The plurality of switching units 130 is connected in series to each of the plurality of LED arrays 120, and varies a size of the driving current which flows in each of the plurality of LED arrays 120. Specifically, the plurality of switching units 130 includes resistors and switching components, and each of the switching components may be, for example, a bipolar junction transistor (BJT) or a field effect transistor (FET). The configuration and operation of the plurality of switching units 130 will be explained in detail hereinafter with reference to FIG. 2.

The control unit 200 may calculate the driving voltage to be supplied to the plurality of LED arrays 120 in order for each of the plurality of switching units 130 to operate within the predetermined headroom voltage range and may control the DC-DC converter 110 for the calculated driving voltage to be supplied to the plurality of LED arrays 120. Specifically, the control unit 200 may calculate a sum of the forward voltage of the LED array 120 having the largest forward voltage Vf among the plurality of LED arrays 120 and the lower voltage of the predetermined headroom voltage range, and may generate and provide a control signal (for example, a pulse width modulation (PWM) signal) corresponding to the calculated sum of voltage to the DC-DC converter 110 so that the DC-DC converter 110 may generate a driving voltage corresponding to the calculated sum of voltage.

Then, the control unit 200 calculates a driving voltage of each of the plurality of LED arrays 120 and a duty cycle of the switching units 130 corresponding to the plurality of LED arrays 120 in order for each of the plurality of switching units 130 to operate within the predetermined headroom voltage range, and controls the plurality of switching units 130 based on the calculated driving voltage and the calculated duty cycle. Specifically, the control unit 200 receives brightness information with respect to each of the plurality of LED arrays 120, calculates an average driving voltage of each of the plurality of LED arrays 120 based on the received brightness information, calculates a duty cycle of each of the plurality of switching units 130 based on the calculated average driving voltage and the calculated driving voltage, and controls the plurality of switching units 130 based on the calculated driving voltage and the calculated duty cycle. According to an exemplary embodiment, the term "duty cycle" refers to a ratio between a period of time when current flows and a period of time when current does not flow, for an overall time period (a period of time when current flows: a period of time when current does not flow).

The LED driving apparatus 100 according to an exemplary embodiment may solve the problems of efficiency reduction and overheating experienced by a linear switch due to deviation of the forward voltage (Vf) of each of the LED arrays 120 that may occur when the linear mode type circuit is used in order to reduce cost and the number of parts. In addition, the LED driving apparatus 100 according to the exemplary embodiment changes a switch head room voltage level when changing a display mode, thereby preventing current distortion and abnormal protection circuit malfunction.

Figure 2:
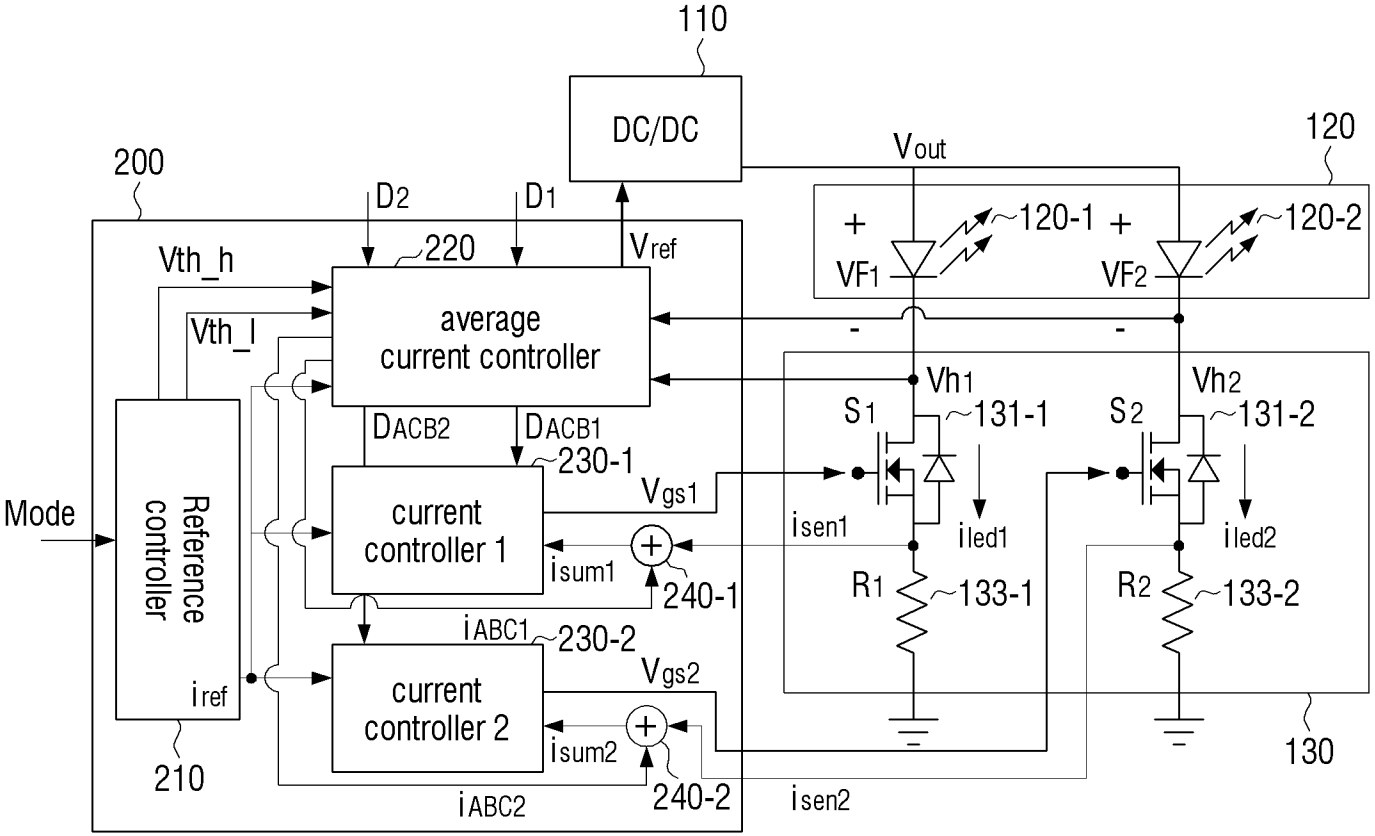
FIG. 2 is a circuit diagram illustrating an LED driving apparatus according to an exemplary embodiment.

FIG. 2 is a circuit diagram illustrating an LED driving apparatus according to an exemplary embodiment.

Referring to FIG. 2, the LED driving apparatus 100 includes the DC-DC converter 110, the plurality of LED arrays 120, the plurality of switching units 130, and the control unit 200.

The DC-DC converter 110 provides a driving voltage to the plurality of LED arrays 120. A detailed operation of the DC-DC converter 110 was explained with reference to FIG. 1 in the above description; therefore, a detailed description thereof will be omitted.t The plurality of LED arrays 120 is formed so that LED arrays 120-1 and 120-2 which each perform a light-emitting operation are connected in parallel. In detail, one end of each of the plurality of LED arrays 120 is connected to the DC-DC converter 110 and provided with the driving voltage, and the other end thereof is connected to one of the plurality of switching units 130. FIG. 2 illustrates that the LED arrays 120-1 and 120-2 each include one LED component. Alternatively, the LED arrays 120-1 and 120-2 may be implemented by a plurality of LED components connected in series. Also, in the exemplary embodiment illustrated in FIG. 2, the plurality of LED arrays 120 includes only two LED arrays 120-1 and 120-2; however, the plurality of LED arrays 120 may be implemented to include three or more LED arrays.

Each of the plurality of switching units 130 includes a resistor 133 and a switching component 131. The exemplary embodiment shown in FIG. 2 is illustrated such that the plurality of switching units 130 includes two switching units 130-1 and 130-2; however, when the plurality of LED arrays 120 is implemented to include three or more LED arrays 120, the plurality of switching units 130 may include switching units corresponding to the number of LED arrays 120 that make up the plurality of LED arrays 120.

One end of each of the resistors 133-1 and 133-2 is connected to the corresponding switching component 131-1 or 131-2, and the other end thereof is grounded. According to an exemplary embodiment, the resistor 133 measures a value of current that flows in the LED arrays 120, and voltage of a node which the switching component 131 and the resistor 133 commonly contact is connected to the control unit 200.

One end of each of the switching components 131-1 and 131-2 is connected to a corresponding LED array of the LED arrays 120-1 and 120-2, and the other end thereof is connected to a corresponding resistor of the resistors 133-1 and 133-2. According to an exemplary embodiment, the switching components 131-1 and 131-2 may each be implemented as a field effect transistor (FET) including a drain connected to one end of the LED arrays 120, a gate connected to a corresponding one of the current controllers 230-1 and 230-2 of the control unit 200, and a source grounded through a corresponding one of the resistors 133. Operation characteristics of the FET according to an exemplary embodiment are illustrated in FIG. 5. As illustrated in FIG. 5, the FET may vary current which flows therethrough according to the voltage VGS of the gate.

In the above description, an FET is exemplarily described as being used as the switching component 131. Alternatively, when implementing, a bipolar junction transistor (BJT) may be used as the switching component 131. In this case, the BJT may include a collector connected to one end of an LED array 120, a base connected to the current controller, and an emitter grounded through a resistor. Then, the current to flow therethrough may be varied by varying the base voltage VBE of the BJT.

In the above description, only FET and BJT have been described as examples of the switching component; however, other exemplary embodiments are not limited to using an FET or a BJT. In addition to the FET and BJT, various other types of components may be used as the switching component according to other exemplary embodiments, as long as the other components can vary the size of the current.

The control unit 200 includes a reference controller 210, an average current controller 220, a plurality of current controllers 230, and a plurality of comparators 240. The control unit 200 may be implemented as one chip, or may be implemented as a plurality of chips.

The reference controller 210 may calculate an average current of each of the plurality of LED arrays 120, and generate the upper voltage value Vth_h and lower voltage value Vth_l of the predetermined headroom voltage range. In detail, the reference controller 210 may receive brightness information with respect to each of the plurality of LED arrays 120, and calculate average driving current of each of the plurality of LED arrays 120 based on the received brightness information. The present exemplary embodiment has been described as having a configuration in which the reference controller 210 receives the brightness information from an external source and calculates the average current based on the received brightness information; however, other exemplary embodiments are not limited thereto, and may be implemented such that the reference controller 210 directly receives the average current of each of the plurality of LED arrays 120 from the external source. Also, other exemplary embodiments may be implemented such that the reference controller 210 receives operation mode information of a display apparatus (not illustrated) from the external source, and calculates the average current of each of the plurality of LED arrays 120 by using stored brightness information of an LED array 120 corresponding to the received operation mode information.

Then, the reference controller 210 may generate the upper voltage value Vth_h and lower voltage value Vth_l of the predetermined headroom voltage range. The predetermined headroom voltage range may be input from an external apparatus or may be stored in the reference controller 210. According to an exemplary embodiment, the reference controller 210 stores a plurality of headroom voltage ranges corresponding to operation modes of the display apparatus (not illustrated), and when an operation mode of the display apparatus is input from the external source, the reference controller 210 outputs an upper voltage value Vth_h and lower voltage value Vth_l of a headroom voltage range corresponding to the input operation mode.

The average current controller 220 may calculate a driving voltage to be supplied to the plurality of LED arrays 120 in order for each of the plurality of switching units 130 to operate within the predetermined headroom voltage range, and may control the DC-DC converter 110 to supply the calculated driving voltage to the plurality of LED arrays 120. In detail, the average current controller 220 may calculate a sum of a forward voltage of the LED array 120 having the largest forward voltage among the plurality of LED arrays 120 and the lower voltage of the predetermined headroom voltage range, and may control the DC-DC converter 110 so that a driving voltage corresponding to the calculated sum of the voltages is provided to the plurality of LED arrays 120.

In order for each of the plurality of switching units 130 to operate between the upper voltage value Vth_h and the lower voltage value Vth_l, the average current controller 220 calculates a driving current of each of the plurality of LED arrays 120 and a duty cycle of each of the plurality of switching units 130 corresponding to the plurality of LED arrays 120 by using the calculated average driving current. In detail, in order for each of the plurality of switching units 130 to operate between the upper voltage value and lower voltage value, the average current controller 220 may calculate a driving current of each of the plurality of LED arrays 120 by using the average driving current calculated in the reference controller 210. In more detail, the average current controller 220 may calculate a driving current which has a value which is increased compared to a value of the average driving current calculated with respect to the other LED arrays 120 except for the LED array 120 having the largest forward voltage among the plurality of LED arrays 120. The above-described calculation of the driving current may be performed with respect to the other LED arrays 120 except for the LED array having the largest forward voltage among the plurality of LED arrays 120.

Then, the average current controller 220 calculates a duty cycle with respect to each of the plurality of switching units 130 based on the calculated driving current. In detail, the average current controller 220 may calculate a duty cycle which is lower than the duty cycle of the LED array 120 having the largest forward voltage with respect to the other LED arrays 120 except for the LED array 120 having the largest forward voltage among the plurality of LED arrays 120. For example, since a driving current larger than the calculated average driving current value flows in the other LED arrays 120 except for the LED array 120 which is operated by the largest forward voltage, the duty cycle which is lower than the duty cycle with respect to the LED array 120 having the largest forward voltage may be used to allow current to flow in the other LED arrays 120 except for the LED array 120 having the largest forward voltage.

Then, the average current controller 220 provides the plurality of current controllers 230 with the calculated driving current and duty cycle. In detail, the average current controller 220 may provide the driving current and duty cycle calculated per LED array to each of the current controllers 230 corresponding to the LED arrays 120.

Each of the plurality of current controllers 230 controls a corresponding one of the plurality of switching units 130 based on the calculated driving current and duty cycle. In detail, each of the plurality of current controllers 230 may generate a driving voltage VGS of the corresponding switching component 131 corresponding to the calculated driving current so that current having a value corresponding to the calculated driving current flows in the corresponding LED array 120, and may provide the generated driving voltage of the switching component 131 to the corresponding switching component 131.

Figure 3:
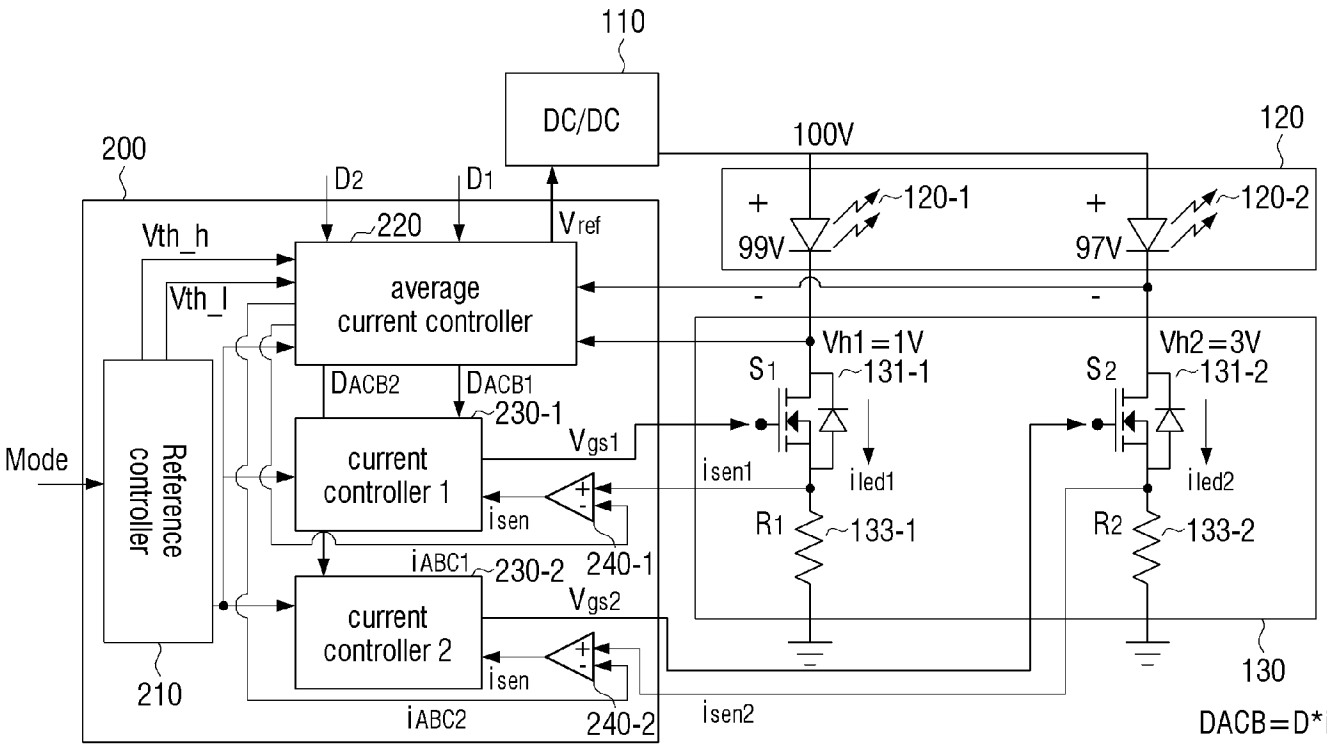
FIG. 3 is a view illustrating a configuration of a control unit according to a first exemplary embodiment.
Figure 4:
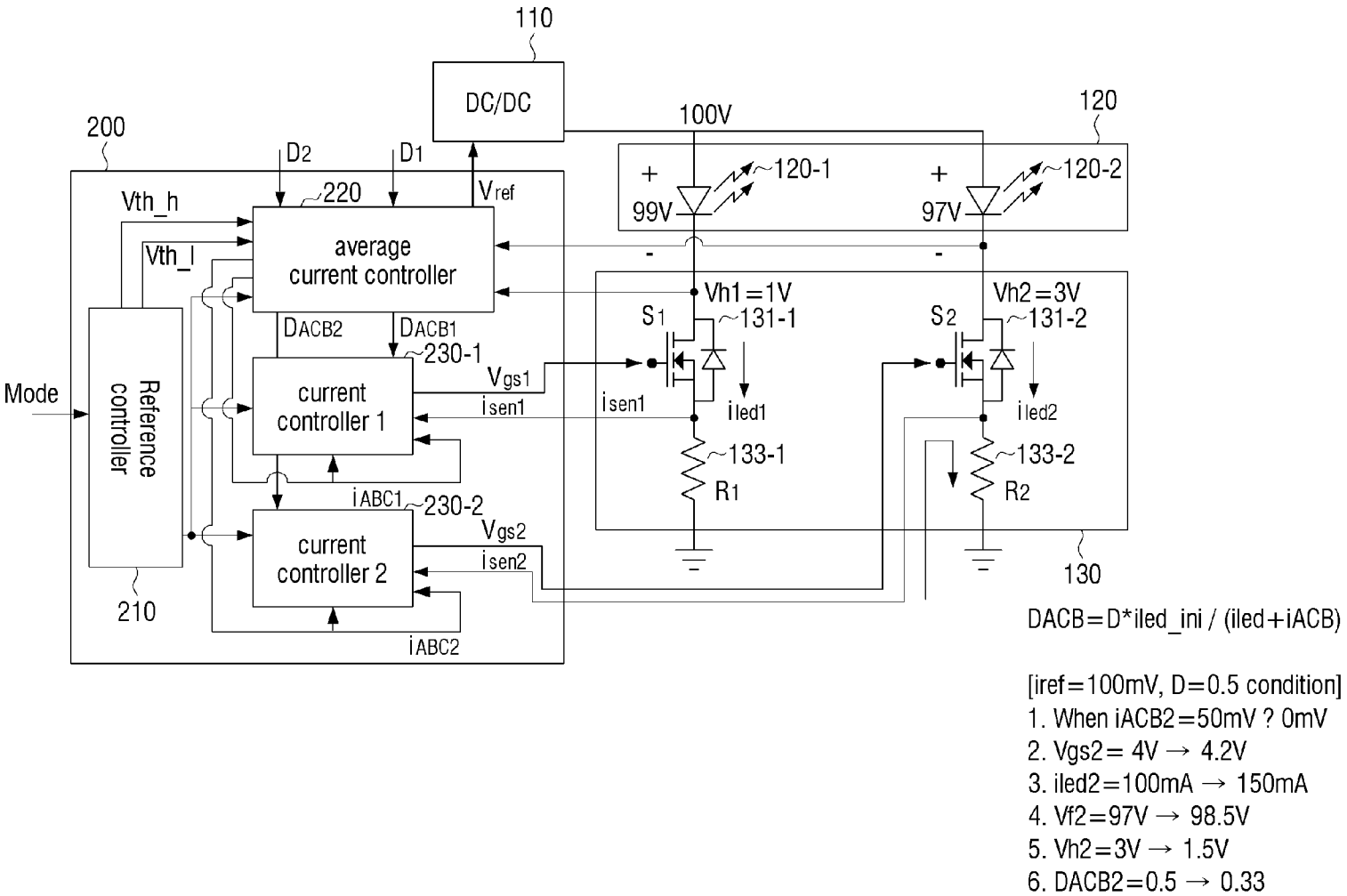
FIG. 4 is a view illustrating a configuration of a control unit according to a second exemplary embodiment.

Then, each of the plurality of current controllers 230 may detect the value of current flowing in a corresponding one of the LED arrays 120, and perform feedback control based on the detected value of current. In detail, according to an exemplary embodiment, each of the plurality of current controllers 230 may measure the value of current flowing in the corresponding LED array 120 by using the voltage value of the resistor 133, and perform feedback control with respect to the corresponding switching unit 130 by comparing the measured value of current and the driving current provided from the average current controller 220. According to another exemplary embodiment, the plurality of current controllers 230 may be implemented to receive both the voltage value of the resistor and the driving current as illustrated in FIG. 4. According to another exemplary embodiment, as illustrated in FIG. 3, the plurality of current controllers 230 may be implemented to receive a value having a difference between the voltage value of the resistor 133 and the value of the voltage corresponding to the driving current from an external comparator 240, and to perform feedback control. In the illustrated exemplary embodiments, the plurality of current controllers 230 is illustrated to include only a first current controller 230-1 and a second current controller 230-2; however, when the plurality of LED arrays 120 is implemented to include three or more LED arrays 120, the plurality of current controllers 230 may have current controllers 230 corresponding to the number of the LED arrays 120 forming the plurality of LED arrays 120.

Each of the plurality of comparators 240 outputs a difference between the value of the voltage corresponding to the driving voltage and the voltage value of the corresponding resistor 133. In detail, each of the plurality of comparators 240 may receive the value of the voltage corresponding to the driving voltage calculated in the average current controller 220 and the voltage value of the corresponding resistor 133 of the corresponding switching unit 130, and may provide the difference thereof to the corresponding current controller 230. In the exemplary embodiment illustrated in FIG. 2, the plurality of comparators 240 is illustrated to include only a first comparator 240-1 and a second comparator 240-2; however, when the plurality of LED arrays 120 is implemented to include three or more LED arrays 120, the plurality of comparators 240 may have comparators corresponding to the number of the LED arrays 120 forming the plurality of LED arrays 120.

Hereinafter, an operation of the control unit will be explained in detail with reference to FIGS. 3 and 4.

FIG. 3 is a view illustrating a configuration of a control unit according to a first exemplary embodiment. In detail, the control unit 200 according to the first exemplary embodiment uses comparators 240 as illustrated in FIG. 2.

According to the first exemplary embodiment, a forward voltage Vf of a first LED array 120-1 is 99V, and a forward voltage of a second LED array 120-2 is 97V. The predetermined headroom voltage range is between 1V and 1.5V. A current reference value signal (iref) of each of the LED arrays 120 is 100 mV, a current of each of the LED arrays 120 is 100 mA, and a basic duty cycle is 0.5.

In the above-described state, the control unit 200 may control the DC-DC converter 110 to output the driving voltage of 100V (the forward voltage of the first LED array (99V)+the lower voltage value of the predetermined headroom voltage range (1V)). When the DC-DC converter 110 outputs the driving voltage of 100V as described above, the headroom voltage of the first switching component 131-1 is 1V, and the headroom voltage of the second switching component 131-2 is 3V.

Since the headroom voltage (3V) of the second switching component 131-2 is not within the predetermined headroom voltage range (1V~1.5V), the control unit 200 may increase step by step the gate voltage of the second switching component 131-2 so as to increase step by step current flowing in the second LED array 120-2. As a result, the headroom voltage of the second switching component 131-2 is located within the predetermined headroom voltage range (1V~1.5V). At this time, the gate voltage of the second switching component 131-2 rises from 4V to 4.2V, and the current flowing in the second LED array 120-2 is increased from 100 mA to 150 mA.

An increase in the current flowing in the second LED array 120-2 causes brightness to increase. Therefore, the control unit 200 may vary the duty cycle of the second switching component 131-2 corresponding to the second LED array 120-2 from 0.5 to 0.33 in order for the second LED array 120-2 to maintain a desired brightness level. As a result, the average brightness of the second LED array 120-2 is the same as that before the driving current is varied.

According to this above-described exemplary embodiment, a loss in power in the second switching component 131-2 may be decreased by approximately 60%. In detail, when being driven by a conventional method, the second switching component 131-2 consumes electrical power of 2.9V×0.1A×0.5=145 mW. However, when being driven as described above, the second switching component 131-2 consumes the electrical power of 1.35V×0.15A×0.33=57 mW.

FIG. 4 is a view illustrating a configuration of a control unit according to a second exemplary embodiment. In detail, the control unit 200 according to the second exemplary embodiment does not have comparators. Instead, an operation corresponding to an operation performed by the comparator is performed inside the current controllers 230. The control unit 200 according to the second exemplary embodiment is different in the configuration from the control unit 200 as illustrated in FIGS. 2 and 3. However, the operation of the control unit 200 according to the second exemplary embodiment is the same as that of the control unit 200 illustrated in FIGS. 2 and 3.

Figure 6:
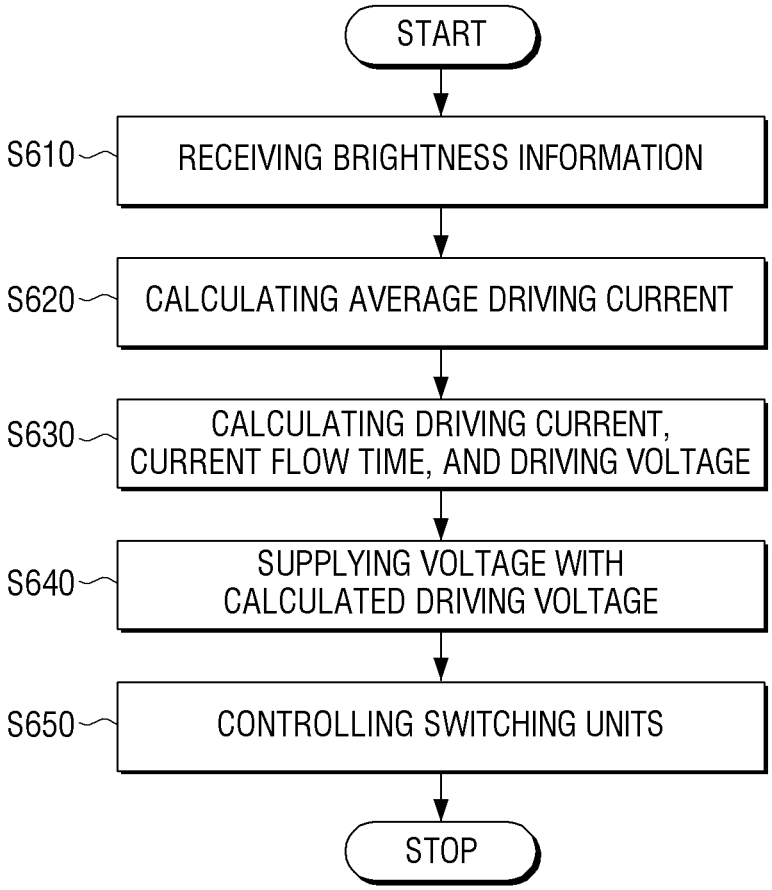
FIG. 6 is a flowchart for explaining an LED driving method according to an exemplary embodiment.

FIG. 6 is a flowchart for explaining a LED driving method according to an exemplary embodiment.

At operation S610, a control unit receives brightness information with respect to each of a plurality of LED arrays. In the present exemplary embodiment, the control unit receives brightness information from an external source, and calculates an average current of each of the plurality of LED arrays in a following step. However, according to other exemplary embodiments, the control unit may be implemented to receive an average current of each of the plurality of LED arrays directly from the external source. Alternatively, according to other exemplary embodiments, the control unit may be implemented to receive operation mode information of a display apparatus (not illustrated) from the external source and to generate pre-stored brightness information of LED arrays corresponding to the received operation mode.

At operation S620, the control unit calculates an average driving current of each of the plurality of LED arrays 120 based on the received brightness information. Specifically, the control unit may calculate the average driving current of each of the plurality of LED arrays corresponding to the received brightness information by using a lookup table in which values of average driving current corresponding to the brightness information are recorded.

At operation S630, the control unit calculates a driving current of each of the plurality of LED arrays in order for each of the plurality of switching units to operate within a predetermined headroom voltage range. Specifically, the control unit may calculate a value of driving current which is increased compared to an average driving current calculated with respect to the other LED arrays except for a LED array having the largest forward voltage among the plurality of LED arrays. The above-described calculation of the driving current may be performed with respect to the other LED arrays except for the LED array having the largest forward voltage among the plurality of LED arrays.

Furthermore, at operation S630, the control unit calculates a duty cycle of each of the plurality of the switching units based on the calculated average driving current and the calculated driving current. Specifically, the control unit may calculate a duty cycle which is lower than the duty cycle of the LED array having the largest forward voltage with respect to the other LED arrays except for the LED array having the largest forward voltage among the plurality of LED arrays. For example, since a driving current which is larger than the calculated average driving current value flows in the other LED arrays except for the LED array which operates according to the largest forward voltage, the duty cycle which is lower than the duty cycle with respect to the LED array having the largest forward voltage may be used to allow current to flow in the other LED arrays except for the LED array having the largest forward voltage.

Furthermore, at operation S630, the control unit calculates a driving voltage that will be supplied to the plurality of LED arrays in order for each of the plurality of switching units to operate within the predetermined headroom voltage range. Specifically, the control unit may calculate a sum of a voltage of the LED array having the largest forward voltage among the plurality of LED arrays and the lower voltage of the predetermined headroom voltage range.

Then, at operation S640, the control unit generates a control signal (for example, a PWM signal) corresponding to the calculated sum of voltages, and provides the generated control signal to a DC-DC converter so that the DC-DC converter may supply the plurality of LED arrays with a driving voltage corresponding to the calculated sum of voltages.

Then, at operation S650, the control unit controls the plurality of switching units based on the calculated driving current and the calculated duty cycle. Specifically, in order for an input driving current to flow into the corresponding LED array, the control unit may generate a driving voltage VGS of the switching unit corresponding to the driving current, and may provide the generated driving voltage of the switching unit to the corresponding switching unit. At this time, the control unit may detect a value of current flowing in each of the LED arrays, and may perform feedback control with respect to the driving current to flow in the plurality of LED arrays.

Accordingly, the LED driving method according to the present exemplary embodiment can solve problems of efficiency reduction and overheating of linear switches caused by excessive heat being be generated due to a deviation of forward voltage per LED array, when a linear mode type circuit is used in order to reduce cost and the number of components. Also, the LED driving method according to the present exemplary embodiment can prevent current distortion and abnormal protection circuit malfunction by varying a switch head room voltage level when a display mode is changed. The LED driving method as illustrated in FIG. 6 may, for example, be carried out on a LED driving apparatus having the configuration as illustrated in FIG. 1, or on LED driving apparatuses having other configurations according to other exemplary embodiments.

Also, the LED driving method according to an exemplary embodiment as described above may be implemented as at least one execution program for executing the LED driving method as described above. The execution program may be stored on a computer-readable recording medium.

Accordingly, each block of the exemplary embodiments may be executed as a computer-recordable code of the computer-readable recording medium. The computer-readable recording medium may be implemented as a device which is capable of storing data which can be read by a computer system.

While exemplary embodiments have been described, additional variations and modifications of the exemplary embodiments may occur to those skilled in the art once they learn of the basic concepts. Therefore, it is intended that the appended claims shall be construed to include both the above exemplary embodiments and all such variations and modifications that fall within the spirit and scope of the concepts of the exemplary embodiments.

What is claimed is:

1. A light emitting diode (LED) driving apparatus which drives a plurality of LED arrays, the LED driving apparatus comprising:

a DC-DC converter which provides a driving voltage to the plurality of LED arrays;

a plurality of switching units, each of the switching units being connected in series to a corresponding LED array of the plurality of LED arrays and varying a size of a driving current to flow in the corresponding LED array of the plurality of LED arrays; and a control unit which, in order for each of the switching units to operate within a predetermined headroom voltage range, calculates a driving current of each of the plurality of LED arrays and a duty cycle of the switching units corresponding to each of the plurality of LED arrays, and controls the plurality of switching units based on the calculated driving current and the calculated duty cycle, wherein the control unit receives brightness information with respect to each of the plurality of LED arrays, calculates an average driving current of each of the plurality of LED arrays based on the received brightness information, calculates the driving current to be supplied to each of the plurality of LED arrays so that each of the corresponding plurality of switching units operate within the predetermined headroom voltage range, calculates a duty cycle of each of the plurality of switching units based on the calculated average driving current and the calculated driving current, and controls the plurality of switching units based on the calculated driving current and the calculated duty cycle.

2. The LED driving apparatus of claim 1, wherein the control unit controls the DC-DC converter to provide the plurality of LED arrays with a sum of a forward voltage of an LED array having a largest forward voltage among the plurality of LED arrays and a lower voltage of the predetermined headroom voltage range as the driving voltage.

3. The LED driving apparatus of claim 1, wherein the control unit comprises:

a reference controller which calculates an average driving current of each of the plurality of LED arrays and generates an upper voltage value and a lower voltage value of the predetermined headroom voltage range;

an average current controller which calculates a driving current of each of the plurality of LED arrays by using the calculated average driving current, and further calculates a duty cycle of the switching units corresponding to each of the plurality of LED arrays by using the calculated average driving current, the driving current and the duty cycle being calculated in order for each of the plurality of switching units to operate between the upper voltage value and the lower voltage value; and a plurality of current controllers, each of the current controllers controlling a corresponding switching unit of the plurality of switching units based on the calculated driving current and the calculated duty cycle.

4. The LED driving apparatus of claim 3, wherein the reference controller receives brightness information with respect to each of the plurality of LED arrays, and calculates the average driving current of each of the plurality of LED arrays based on the received brightness information.

5. The LED driving apparatus of claim 3, wherein:

the average current controller controls the DC-DC converter to supply the calculated driving voltage to the plurality of LED arrays.

6. The LED driving apparatus of claim 5, wherein the average current controller controls the DC-DC converter to supply a sum of a forward voltage of the LED array having a largest forward voltage among the plurality of LED arrays and a lower voltage of the predetermined headroom voltage range as the driving voltage with respect to the plurality of LED arrays.

7. The LED driving apparatus of claim 3, wherein:

the average current controller calculates the driving current of each of the plurality of LED arrays by using the calculated average driving current in order for each of the plurality of switching units to operate between the upper voltage value and the lower voltage value, and calculates the duty cycle of each of the plurality of switching units based on the average driving current calculated by the reference controller and the calculated driving current.

8. The LED driving apparatus of claim 7, wherein in order for each of the plurality of switching units to operate between the upper voltage value and the lower voltage value, the average current controller calculates a driving current having a value which is increased compared to the average driving current calculated with respect to the other LED arrays except for the LED array having a largest forward voltage among the plurality of LED arrays.

9. The LED driving apparatus of claim 8, wherein the average current controller calculates a duty cycle which is lower than a duty cycle of the LED array having the largest forward voltage with respect to the other LED arrays except for the LED array having the largest forward voltage among the plurality of LED arrays.

10. The LED driving apparatus of claim 3, wherein each of the plurality of switching units comprises:

a resistor comprising one end which is grounded; and a switching component connected in series between the corresponding LED array and the resistor.

11. The LED driving apparatus of claim 10, wherein:

the switching component comprises a bipolar junction transistor (BJT) comprising a collector which is connected to one end of the corresponding LED array, a base connected to the corresponding current controller, and an emitter grounded through the resistor; and each of the plurality of current controllers provides the base of the corresponding BJT with a value of voltage corresponding to the calculated driving current.

12. The LED driving apparatus of claim 10, wherein:

the switching component comprises a field effect transistor (FET) comprising a drain connected to one end of the corresponding LED array, a gate connected to the corresponding current controller, and a source grounded through the resistor, and each of the plurality of current controllers provides the gate of the corresponding FET with a value of voltage corresponding to the calculated driving current.

13. The LED driving apparatus of claim 10, wherein:

each of the current controllers performs feedback control of a driving current to flow in the corresponding LED array by using a voltage value of the resistor.

14. The LED driving apparatus of claim 13, wherein the control unit further comprises a plurality of comparators corresponding to the plurality of switching units, each of the comparators outputting a difference between the value of voltage corresponding to the driving current calculated in the average current controller and the voltage value of the resistor in the corresponding switching unit.

15. The LED driving apparatus of claim 14, wherein each of the plurality of current controllers performs feedback control of a driving current to flow in the corresponding LED array based on an output of the corresponding comparator.

16. A light emitting diode (LED) driving method of an LED driving apparatus which comprises a plurality of LED arrays and a plurality of switching units configured to vary a size of a driving current to flow in each of the plurality of LED arrays, the LED driving method comprising:

receiving brightness information with respect to each of the plurality of LED arrays;

calculating an average driving current of each of the plurality of LED arrays based on the received brightness information;

calculating a driving current of each of the plurality of LED arrays in order for each of the plurality of switching units to operate within a predetermined headroom voltage range;

calculating a duty cycle of each of the plurality of switching units based on the calculated average driving current and the calculated driving current; and controlling the plurality of switching units based on the calculated driving current and the calculated duty cycle.

17. The LED driving method of claim 16, wherein the calculating of the driving current comprises calculating the driving current to have a value which is increased compared to the average driving current calculated with respect to the other LED arrays except for an LED array having a largest forward voltage among the plurality of LED arrays in order for each of the plurality of switching units to operate within the predetermined headroom voltage range.

18. The LED driving method of claim 17, wherein the calculating of the duty cycle comprises calculating the duty cycle to be lower than a duty cycle of the LED array having the largest forward voltage with respect to the other LED arrays except for the LED array having the largest forward voltage among the plurality of LED arrays.

19. A non-transitory computer-readable recording medium comprising a program for executing a light emitting diode (LED) driving method in an LED driving apparatus which comprises a plurality of LED arrays and a plurality of switching units configured to vary a size of a driving current to flow in each of the plurality of LED arrays, the non-transitory computer-readable recording medium causing a computer to execute the LED driving method comprising:

receiving brightness information with respect to each of the plurality of LED arrays;

calculating an average driving current of each of the plurality of LED arrays based on the received brightness information;

calculating a driving current of each of the plurality of LED arrays in order for each of the plurality of switching units to operate within a predetermined headroom voltage range;

calculating a duty cycle of each of the plurality of switching units based on the calculated average driving current and the calculated driving current; and controlling the plurality of switching units based on the calculated driving current and the calculated duty cycle.

* * * * *